United States Patent [19]

Howell et al.

[11] Patent Number: 4,592,830

[45] Date of Patent: Jun. 3, 1986

[54] HYDROVISBREAKING PROCESS FOR HYDROCARBON CONTAINING FEED STREAMS

[75] Inventors: Jerald A. Howell; Donald C. Tabler; Donald M. Haskell, all of Bartlesville, Okla.

[73] Assignee: Phillips Petroleum Company, Bartlesville, Okla.

[21] Appl. No.: 714,778

[22] Filed: Mar. 22, 1985

[51] Int. Cl.[4] ..... C10G 7/06; C10G 47/32

[52] U.S. Cl. ..... 208/94; 208/56; 208/87; 208/107; 208/112; 196/14.52; 196/100; 422/129

[58] Field of Search ..... 208/107, 108, 112, 94, 208/56, 87, 95; 196/100, 14.52; 422/129

[56] References Cited

U.S. PATENT DOCUMENTS

| | | | |
|---|---|---|---|
| 2,844,524 | 7/1958 | Ernst | 208/94 |
| 2,850,436 | 9/1958 | Beuther et al. | 208/94 |
| 3,110,663 | 11/1963 | Miller | 208/94 |
| 3,185,639 | 5/1965 | Paterson | 208/108 |
| 3,252,888 | 5/1966 | Langer, Jr. et al. | 208/112 |
| 3,796,653 | 3/1974 | Gatsis | 208/95 |
| 4,389,302 | 6/1983 | Garwin et al. | 208/87 |
| 4,389,303 | 6/1983 | Simo et al. | 208/56 |
| 4,434,045 | 2/1984 | Vernon et al. | 208/107 |

*Primary Examiner*—Andrew H. Metz
*Assistant Examiner*—Anthony McFarlane
*Attorney, Agent, or Firm*—French and Doescher

[57] ABSTRACT

A hydrogen donor solvent selected from the group consisting of a full range crude oil and an atmospheric topped crude oil is used in a hydrovisbreaking process. The heavy fraction being processed is heated in the presence of hydrogen and the solvent under suitable hydrovisbreaking conditions. As a result, the amount of heavies in the feed to the hydrovisbreaking process is substantially reduced.

11 Claims, 4 Drawing Figures

HYDROVISBREAKING PROCESS FOR HYDROCARBON CONTAINING FEED STREAMS

This invention relates to a hydrovisbreaking process for hydrocarbon containing feed streams. In one aspect, this invention relates to a novel solvent for a hydrovisbreaking process.

It is often desirable to reduce the amount of heavies in the heavier fractions such as topped crude and residuum obtained during the processing of a crude oil. As used herein, the term heavies refers to the fraction having a boiling range higher than about 1000° F. This reduction results in the production of lighter components which are of higher value and which are more easily processed.

A hydrovisbreaking process is a process which can be used to crack a feedstock. Hydrovisbreaking is generally characterized by a heat soak in the presence of hydrogen. However, while a heat soak in the presence of hydrogen is effective to crack fractions lighter than a topped crude, a hydrogen donor solvent must be used when hydrovisbreaking topped crudes or residuum to enhance the transfer of hydrogen to the heavies.

It is thus an object of this invention to provide a novel solvent for a hydrovisbreaking process used to process heavier fractions such as topped crude and residuum.

In accordance with the present invention, a hydrogen donor solvent selected from the group consisting of a full range crude oil and an atmospheric topped crude oil is used in a hydrovisbreaking process. The heavy fraction being processed is heated in the presence of hydrogen and the solvent under suitable hydrovisbreaking conditions. As a result, the amount of heavies in the feed to the hydrovisbreaking process are substantially reduced by means of cracking. The solvent of the present invention is cheaper than other solvents which might be employed which is of considerable importance when processing heavy fractions such as topped crude or residuum.

Other objects and advantages of the invention will be apparent from the foregoing brief description of the invention and the appended claims as well as the detailed description of the drawings which are briefly described as follows:

Any suitable hydrocarbon containing feed stream may be processed in accordance with the present invention. Such suitable hydrocarbon containing feed streams will generally contain a high concentration of heavies. The invention is particularly directed to processing heavy topped crudes, residuum and other materials which are generally regarded as too heavy to be distilled. Again, heavies are defined as those fractions having a boiling range higher than about 1000° F.

Figure 1:
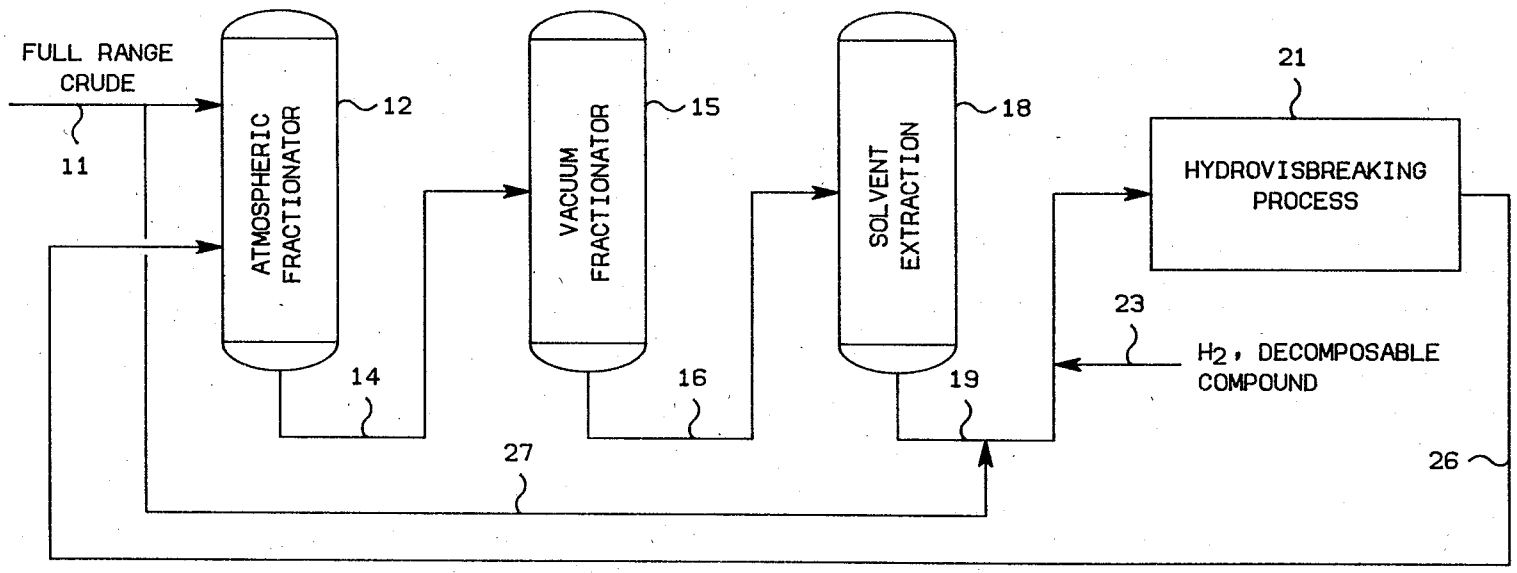
FIG. 1 is a diagrammatic illustration of a process for fractionating a crude oil employing the full range crude as a solvent for the hydrovisbreaking process.

Referring now to FIG. 1, a full range crude (undistilled) is supplied through conduit 11 to the atmospheric fractionator 12. A bottoms stream, which is referred to as atmospheric topped crude, is withdrawn from a lower portion of the atmospheric fractionator 12 through conduit 14 and is provided as a feed to the vacuum fractionator 15.

A bottoms stream, which is referred to as vacuum topped crude, is withdrawn through conduit 16 from a lower portion of the vacuum fractionator 15. The vacuum topped crude is provided as a feed to the solvent extraction column 18. In the solvent extraction column 18, the vacuum topped crude is mixed with a solvent such as propane and a part of the vaccum topped crude will be dissolved in the solvent with the solvent phase being removed from an upper portion of the solvent extraction column 18. A very heavy material, which is referred to as solvent extracted topped crude, is withdrawn from a lower portion of the solvent extraction column 18 through conduit 19 and is provided to the hydrovisbreaking process 21.

Hydrogen is provided to the hydrovisbreaking process 21 through conduit 23. A portion of the crude oil flowing through conduit 11 to the atmospheric fractionator 12 is also provided to the hydrovisbreaking process 21 through conduit 27. This full range crude oil is utilized as the solvent for the hydrovisbreaking process. In addition, a decomposable compound of molybenum, which will be described more fully hereinafter, is also preferably provided to the hydrovisbreaking process 21.

In the hydrovisbreaking process 21, which will be described more fully hereinafter, the amount of heavies in the solvent extracted topped crude is reduced. The reaction effluent from the hydrovisbreaking process 21 is recycled through conduit 26 and is provided as a feed to the atmospheric fractionator 12. Some part of such reaction effluent may be drawn off if desired.

The operation of the atmospheric fractionator, vacuum fractionator and solvent extraction columns are all well known and will not be described more fully hereinafter since such operation plays no part in the present invention other than to provide the desired feed and the desired solvent.

It is also noted that a number of other streams would be withdrawn from the columns and there would be additional equipment such as pumps, heat exchangers, control components, etc. which would typically be associated with the columns. Such additional equipment have not been illustrated since these additional components play no part in the description of the present invention.

Any suitable amount of the full range crude may be provided through conduit 27 as a solvent for the hydrovisbreaking process 21. The amount of full range crude provided to the hydrovisbreaking process 21 will be in the range of about 5 weight percent to about 95 weight percent based on the total weight of the solvent extracted topped crude and full range crude provided to the hydrovisbreaking process 21.

The use of the decomposable compound of molybdenum is not required but is preferred. Particularly preferred molybdenum compounds are molybdenum dithiophosphate and molybdenum dithiocarbamate.

Any suitable molybdenum dithiophosphate compound may be used in the hydrovisbreaking process. Generic formulas of suitable molybdenum dithiophosphates are:

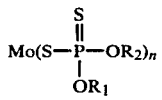

(1)

wherein n=3,4,5,6; $R^1$ and $R^2$ are either independently selected from H, alkyl groups having 1–20 carbon atoms, cycloalkyl or alkylcycloalkyl groups having 3–22 carbon atoms and aryl, alkylaryl or cycloalkylaryl groups having 6–25 carbon atoms; or $R^1$ and $R^2$ are combined in one alkylene group of the structure

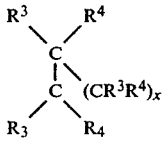

with $R^3$ and $R^4$ being independently selected from H, alkyl, cycloalkyl, alkylcycloalkyl and aryl, alkylaryl and cycloalkylaryl groups as defined above, and x ranging from 1 to 10.

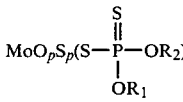

(2)

wherein
p=0,1,2; q=0,1,2; (p+q)=1,2;
r=1,2,3,4 for (p+q)=1 and
r=1,2 for (p+q)=2;

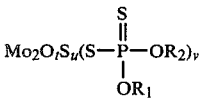

(3)

wherein
t=0,1,2,3,4; u=0,1,2,3,4;
(t+u)=1,2,3,4
v=4,6,8,10 for (t+u)=1; v=2,4,6,8 for (t+u)=2;
v=2,4,6 for (t+u)=3, v=2,4 for (t+u)=4.
Sulfurized oxomolybdenum (V) O,O'-di(2-ethylhexyl)-phosphorodithioate of the formula $Mo_2S_2O_2[S_2P(OC_8H_{17})_2]$ is a particularly preferred additive.

Any suitable molybdenum dithiocarbamate compound may be used in the hydrovisbreaking process. Generic formulas of suitable molybdenum (III), (IV), (V) and (VI) dithiocarbamates are:

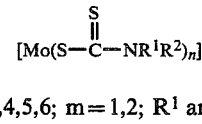

(4)

wherein n=3,4,5,6; m=1,2; $R^1$ and $R^2$ are either independently selected from H, alkyl group having 1–20 carbon atoms, cycloalkyl groups having 3–22 carbon atoms and aryl groups having 6–25 carbon atoms; or $R^1$ and $R^2$ are combined in one alkylene group of the structure

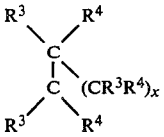

with $R^3$ and $R^4$ being independently selected from H, alkyl, cycloalkyl and aryl groups as defined above, and x ranging from 1 to 10.

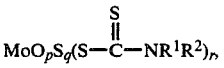

(5)

wherein
p=0,1,2; q=0,1,2; (p+q)=1,2;
r=1,2,3,4 for (p+q)=1 and
r=1,2 for (p+q)=2;

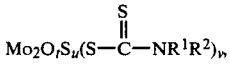

(6)

wherein
t=0,1,2,3,4; u=0,1,2,3,4;
(t+u)=1,2,3,4
v=4,6,8,10 for (t+u)=1; v=2,4,6,8 for (t+u)=2;
v=2,4,6 for (t+u)=3, v=2,4 for (t+u)=4.
Molybdenum(V) di(tridecyl)dithiocarbamate is a particularly preferred additive.

Any suitable concentration of the molybdenum additive may be added to the solvent extracted topped crude flowing through conduit 19. In general, a sufficient quantity of the additive will be added to the solvent extracted topped crude flowing through conduit 19 to result in a concentration of molybdenum metal in the total feed plus solvent in the range of about 1 to about 5000 ppm and more preferably in the range of about 10 to about 1000 ppm.

The hyrovisbreaking process 21 can be carried out by means of any suitable apparatus whereby there is achieved a contact of the solvent extracted topped crude flowing through conduit 19, the decomposable molybdenum compound, hydrogen and the full range crude under suitable hydrovisbreaking conditions. The hydrovisbreaking process can be carried out as a continuous process or as a batch process. The hydrovisbreaking process is in no way limited to the use of any particular type of process or apparatus.

The molybdenum compound may be combined with the feed stream in any suitable manner. The molybdenum compound may be mixed with the feed stream as a solid or liquid or may be dissolved in a suitable solvent (preferably an oil) prior to introduction into the feed stream. Any suitable mixing time may be used. However, it is believed that simply injecting the molybdenum compound into the feed stream is sufficient. No special mixing equipment or mixing period are required.

The pressure and temperature at which the molybdenum compound is introduced into the feed stream is not thought to be critical. However, a temperature above 100° C. is recommended.

Any suitable reaction time in the hydrovisbreaking process may be utilized. In general, the reaction time will range from about 0.01 hours to about 10 hours. Preferably, the reaction time will range from about 0.1 to about 5 hours and more preferably from about 0.25 to about 3 hours. Thus, for a continuous process, the flow rate of the feed should be such that the time required for the passage of the mixture through the reactor (residence time) will preferably be in the range of about 0.1 to about 5 hours and more preferably about 0.25 to about 3 hours. For a batch process, the feed will preferably remain in the reactor for a time in the range of about 0.1 hours to about 5 hours and more preferably from about 0.25 hours to about 3 hours.

The hydrovisbreaking process can be carried out at any suitable temperature. The temperature will generally be in the range of about 250° C. to about 550° C. and will preferably be in the range of about 380° to about 480° C.

Any suitable hydrogen pressure may be utilized in the hydrovisbreaking process. The reaction pressure will generally be in the range of about atmospheric to about 10,000 psig. Preferably, the pressure will be in the range of about 500 to about 3,000 psig. Higher hydrogen pressures tend to reduce coke formation but operation at high pressure may have adverse economic consequences.

Any suitable quantity of hydrogen can be added to the hydrovisbreaking process. The quantity of hydrogen used to contact the feed plus solvent, either in a continous or batch process, will generally be in the range of about 100 to about 20,000 standard cubic feet per barrel of the feed plus solvent and will more preferably be in the range of about 500 to about 5,000 standard cubic feet per barrel of the feed plus solvent.

Figure 2:
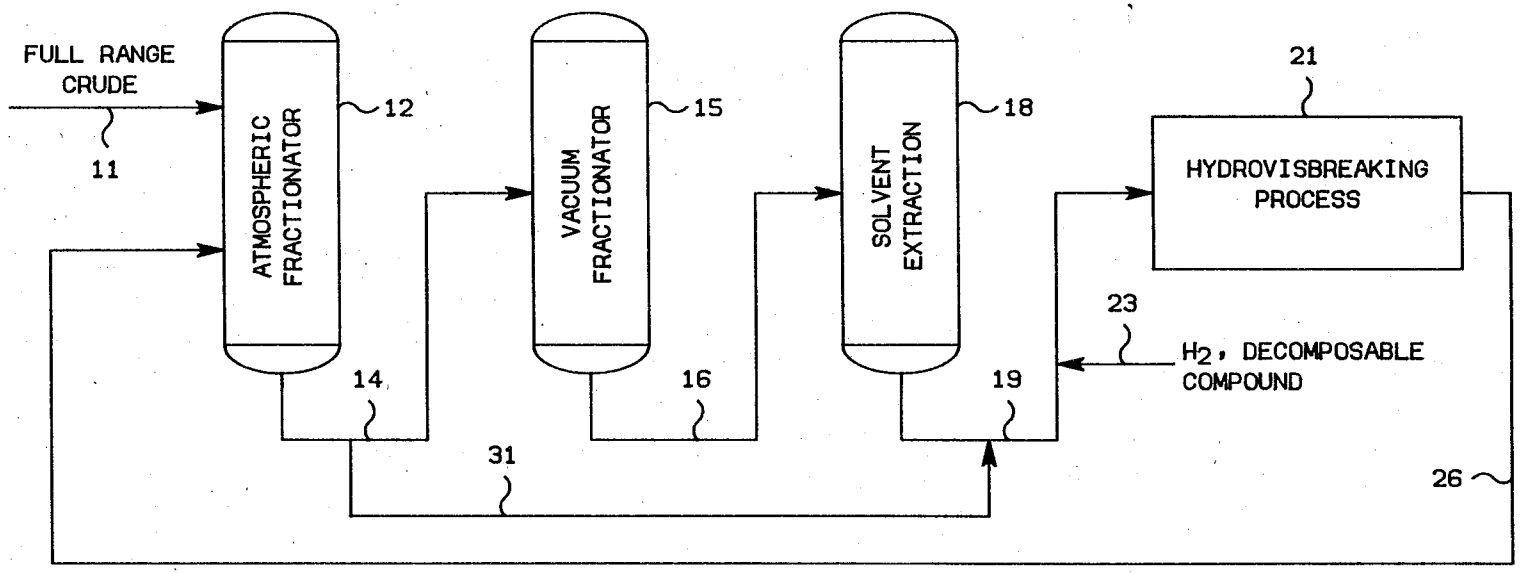
FIG. 2 is a diagrammatic illustration of the process of FIG. 1 employing the atmospheric topped crude as a solvent for the hydrovisbreaking process.

Referring now to FIG. 2, like numbers refer to like equipment in FIG. 1. However, in FIG. 2 a portion of the atmospheric topped crude is provided through conduit 31 as a solvent for the hydrovisbreaking process 21.

Again, any suitable amount of the atmospheric topped crude may be provided to the hydrovisbreaking process 21. The amount will generally be limited by the size of the vessels used in the hydrovisbreaking process 21. The amount of the atmospheric topped crude utilized will generally be in the range of about 5 weight percent to about 95 weight percent based on the total weight of the solvent extracted topped crude and the atmospheric topped crude provided to the hydrovisbreaking process 21.

Figure 3:
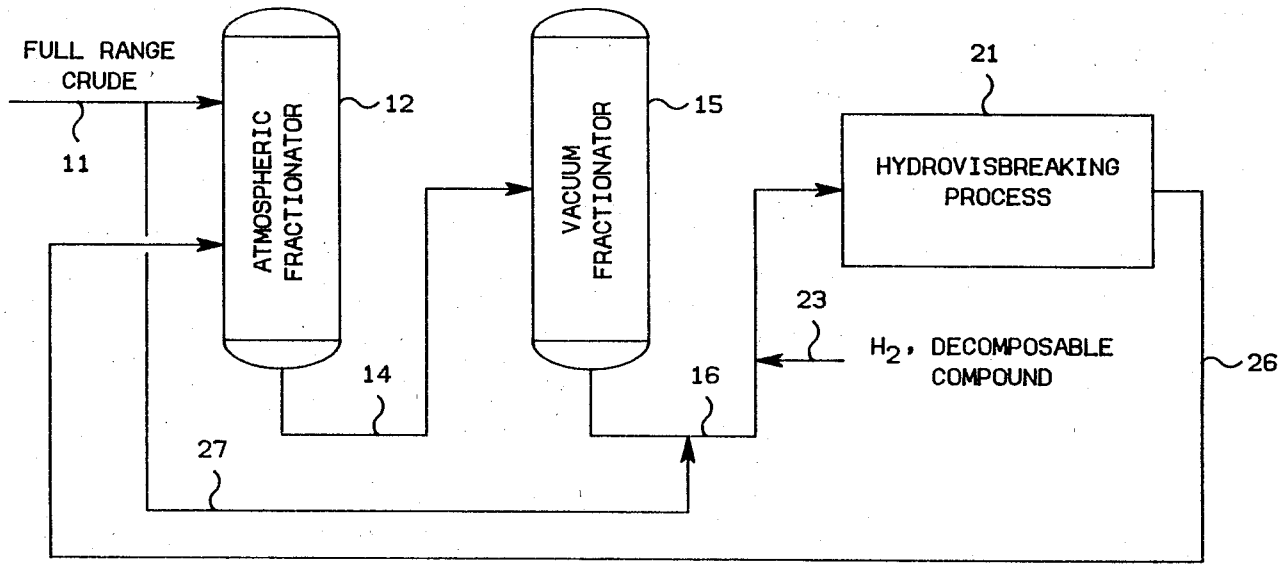
FIG. 3 is a diagrammatic illustration of the process of FIG. 1 without solvent extraction using the full range crude as a solvent for the hydrovisbreaking process.

FIG. 3 illustrates a crude oil fractionating process in which solvent extraction is not utilized. In FIG. 3, for the same volume of full range crude used in a process such as illustrated for FIG. 1, a larger hydrovisbreaking process would be required because of the increased volume of the feed to the hydrovisbreaking process (the volume of the vacuum topped crude is greater than the volume of the solvent extracted topped crude).

Again, a portion of the full range crude is provided as a solvent to the hydrovisbreaking process in the same manner as illustrated for FIG. 1. Any suitable amount may be supplied as a solvent. The amount of the full range crude provided to the hydrovisbreaking process as a solvent will generally be in the range of about 5 weight percent to about 95 weight percent based on the total weight of the vacuum topped crude and full range crude provided to the hydrovisbreaking process 21.

Figure 4:
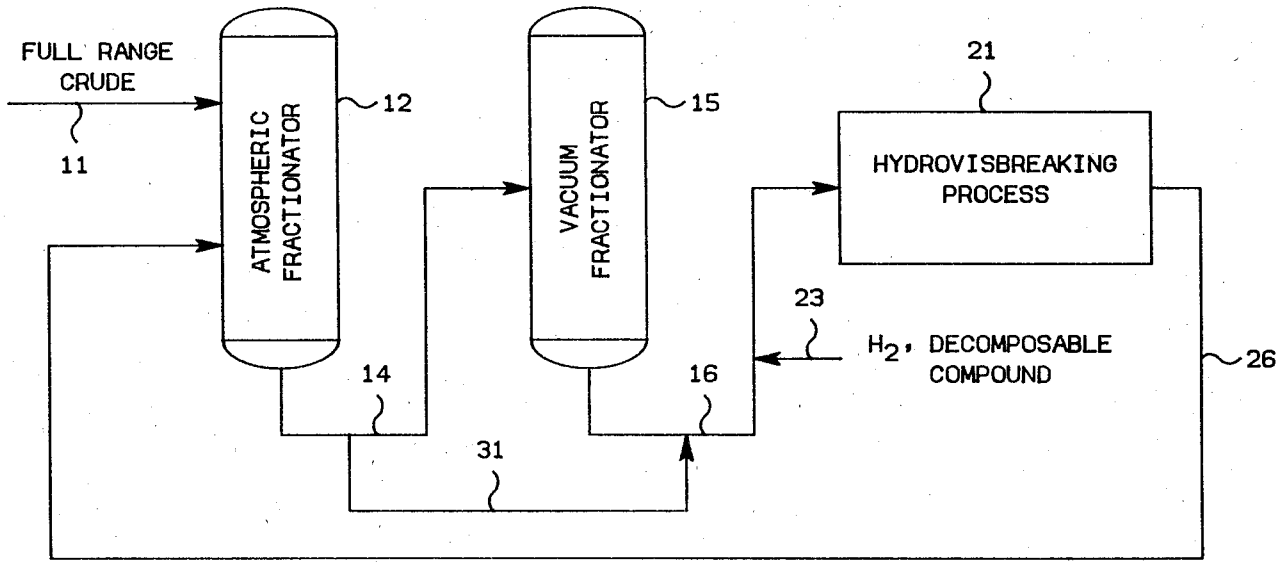
FIG. 4 is a diagrammatic illustration of the process of FIG. 1 without solvent extraction using the atmospheric topped crude as the solvent for the hydrovisbreaking process.

FIG. 4 is a variation of FIG. 3 in which the atmospheric topped crude is employed as a solvent for the hydrovisbreaking process 21. Again, any suitable amount of the atmospheric topped crude may be utilized as a solvent. The amount of the atmospheric topped crude provided to the hydrovisbreaking process will generally be in the range of about 5 weight percent to about 95 weight percent based on the total weight of the vacuum topped crude and atmospheric topped crude provided to the hydrovisbreaking process 21.

The following example is presented in further illustration of the invention:

EXAMPLE 1

A California heavy vacuum topped crude, (Hondo crude cut of 1000+° F. boiling range) was batch hydrovisbroken in a 300 cc autoclave under four conditions:

(1) Hondo vacuum topped crude (1000+° F.) was hydrovisbroken without any added solvent.

(2) Hondo vacuum topped crude (1000+° F.) was hydrovisbroken with about 20 weight percent Tetralin added as a solvent for the hydrovisbreaking.

(3) Hondo vacuum topped crude (1000+° F.) was hydrovisbroken with about 50 weight percent of novel solvent which was a Hondo atmospheric topped crude cut of 650+° F. boiling range.

(4) Hondo vacuum topped crude (1000+° F.) was hydrovisbroken with about 50 weight percent of novel solvent which was a full range raw Hondo crude undistilled.

The conditions and results are tabulated in Table I as follows.

TABLE I

| Test | Base Case | Conventional Solvent | Novel Solvent | Novel Solvent |
|---|---|---|---|---|
| Oil cut, °F. | Hondo 1000+ | Hondo 1000+ | Hondo 1000+ | Hondo 1000+ |
| Solvent | None | Tetralin | Hondo 650+ | Hondo Full Range |
| Oil charge, gms | 142.9 | 78.4 | 56.3 | 30.9 |
| solvent charge, gms | 0 | 20.3 | 57.5 | 84.8 |
| $H_2$ pressure psig | 950 | 1000 | 1000 | 995 |
| Temperature °F. | 798 | 800 | 801 | 785 |
| Residence Time Minutes | 60 | 60 | 60 | 60 |
| Mo additive | Molyvan L | Molyvan L | Molyvan L | Molyvan L |
| Mo charge, ppm* | 390 | 400 | 420 | 130 |
| Results: | | | | |
| Solids make wt % | 18.02 | 4.25 | 9.42 | 6.92 |
| 1000+° F. conversion wt. % | 83.66 | 71.13 | 83.37 | 69.63 |

*PPM Mo based on sum of oil feed plus solvent.

Molyvan ® L is a mixture of about 80 weight-% of a sulfided molybdenum (V) dithiophosphate of the formula $Mo_2S_2O_2[PS_2(OR)_2]$, wherein R is the 2-ethylhexyl group and about 20 weight-% of an aromatic oil (marketed by R. T. Vanderbilt Company).

The results in Table II show that the use of the Hondo 650+° F. cut as a solvent result in more solids make than the use of Tetralin as a solvent but resulted in much less solids than if no solvent at all were used. In additional the use of the Hondo 650+° F. cut also resulted in more conversion than was achieved with the Tetralin solvent. Use of the Hondo 650+° F. cut as a solvent is much more economical than the use of a solvent such as Tetralin.

The use of the full range crude at less favorable conditions (lower hydrogen pressure and lower temperature) also resulted in more solids make than the Tetralin solvent but less solids make than the atmospheric topped crude. Conversion was lower for the full range crude but this can be accounted for by the less favorable conditions. Again, the economics of using the full range crude would be favorable as opposed to a solvent such as Tetralin.

Reasonable variations and modifications are possible within the scope of the disclosure and the appended claims to the invention.

That which is claimed is:

1. A method for processing crude oil comprising steps of:

providing a full range crude oil as a feed to an atmospheric fractionator;

withdrawing an atmospheric topped crude oil from a lower portion of said atmospheric fractionator and providing at least a portion of said atmospheric topped crude oil as a feed to a vacuum fractionator;

withdrawing a vacuum topped crude oil from a lower portion of said vacuum fractionator and providing at least a portion of said vacuum topped crude oil as a feed to a hydrovisbreaker;

supplying hydrogen to said hydrovisbreaker;

supplying a hydrogen donor solvent comprising the full range crude oil supplied to said atmospheric fractionator to said hydrovisbreaker, wherein at least a portion of the heavies in the portion of said vacuum topped crude oil provided to said hydrovisbreaker are cracked in said hydrovisbreaker; and withdrawing the reaction effluent from said hydrovisbreaker.

2. A method in accordance with claim 1 additionally comprising the step of recycling at least a portion of the reaction effluent withdrawn from said hydrovisbreaker as a feed to said atmospheric fractionator.

3. A method in accordance with claim 1 wherein the amount of said full range crude supplied to said hydrovisbreaker is in the range of about 5 weight percent to about 95 weight percent based on the total weight of the vacuum topped crude and full range crude supplied to said hydrovisbreaker.

4. A method in accordance with claim 1 wherein said step of supplying at least a portion of said vacuum topped crude as a feed to said hydrovisbreaker comprises supplying all of said vacuum topped crude as a feed to said hydrovisbreaker.

5. A method in accordance with claim 1 wherein said step of supplying at least a portion of said vacuum topped crude as a feed to said hydrovisbreaker comprises:

supplying said vacuum topped crude oil as a feed to a solvent extraction column; and withdrawing a solvent extracted topped crude from a lower portion of said solvent extraction column and supplying said solvent extracted topped crude as the feed to said hydrovisbreaker.

6. A method in accordance with claim 1 additionally comprising the step of supplying a decomposable molybdenum compound selected from the group consisting of molybdenum dithiophosphates and molybdenum dithiocarbamates to said hydrovisbreaker.

7. Apparatus comprising:

an atmospheric fractionator;

means for providing a full range crude oil as a feed to said atmospheric fractionator;

a vacuum fractionator;

means for withdrawing an atmospheric topped crude oil from a lower portion of said atmospheric fractionator and for providing at least a portion of said atmospheric topped crude oil as a feed to said vacuum fractionator;

a hydrovisbreaker;

means for withdrawing a vacuum topped crude oil from a lower portion of said vacuum fractionator and for providing at least a portion of said vacuum topped crude oil as a feed to said hydrovisbreaker;

means for supplying hydrogen to said hydrovisbreaker;

means for supplying a hydrogen donor solvent comprising the full range crude oil supplied to said atmospheric fractionator to said hydrovisbreaker; and means for withdrawing the reaction effluent from said hydrovisbreaker.

8. Apparatus in accordance with claim 7 additionally comprising means for recycling at least a portion of the reaction effluent withdrawn from said hydrovisbreaker as a feed to said atmospheric fractionator.

9. Apparatus in accordance with claim 7 wherein said means for supplying at least a portion of said vacuum topped crude as a feed to said hydrovisbreaker comprises means for supplying all of said vacuum topped crude as a feed to said hydrovisbreaker.

10. Apparatus in accordance with claim 7 wherein said means for supplying at least a portion of said vacuum topped crude as a feed to said hydrovisbreaker comprises:

a solvent extraction column;

means for supplying said vacuum topped crude oil as a feed to said solvent extraction column; and means for withdrawing a solvent extracted topped crude from a lower portion of said solvent extraction column and for supplying said solvent extracted topped crude as the feed to said hydrovisbreaker.

11. Apparatus in accordance with claim 7 additionally comprising means for supplying a decomposable molybdenum compound selected from the group consisting of molybdenum dithiophosphates and molybdenum dithiocarbamates to said hydrovisbreaker.

* * * * *